US009835007B2

(12) United States Patent
Doane et al.

(10) Patent No.: US 9,835,007 B2
(45) Date of Patent: Dec. 5, 2017

(54) CONTROL INTERFACE FOR SEAL BACK-UP/SLIP

(71) Applicant: Baker Hughes Incorporated, Houston, TX (US)

(72) Inventors: James C. Doane, Friendswood, TX (US); Sean Gaudette, Katy, TX (US)

(73) Assignee: BAKER HUGHES, A GE COMPANY, LLC

( * ) Notice: Subject to any disclaimer, the term of this patent is extended or adjusted under 35 U.S.C. 154(b) by 259 days.

(21) Appl. No.: 14/532,187

(22) Filed: Nov. 4, 2014

(65) Prior Publication Data

US 2016/0123107 A1 May 5, 2016

(51) Int. Cl.
*E21B 33/129* (2006.01)

(52) U.S. Cl.
CPC ..... *E21B 33/129* (2013.01)

(58) Field of Classification Search
CPC .... E21B 33/129; E21B 33/1291; E21B 29/00; E21B 23/06
USPC ..... 166/207
See application file for complete search history.

(56) References Cited

U.S. PATENT DOCUMENTS 3,497,002 A * 2/1970 Berryman ..... E21B 33/129 166/123
7,353,879 B2 * 4/2008 Todd ..... E21B 23/00 166/317
2004/0251032 A1 * 12/2004 Luke ..... E21B 21/08 166/373
2007/0102165 A1 * 5/2007 Slup ..... E21B 33/1204 166/387
2008/0236844 A1 * 10/2008 Gaudette ..... E21B 23/06 166/387
2014/0216722 A1 * 8/2014 Badrak ..... E21B 33/129 166/206
2014/0262344 A1 * 9/2014 Standridge ..... E21B 33/134 166/382
2015/0129239 A1 * 5/2015 Richard ..... E21B 23/06 166/377

* cited by examiner

*Primary Examiner* — Giovanna C. Wright
*Assistant Examiner* — Kristyn A Hall
(74) *Attorney, Agent, or Firm* — Shawn Hunter

(57) ABSTRACT

Plug devices have an expander swage element, a rupturable slip element and a pusher sub. The pusher sub and slip element have a control protrusion and recess interface which guides segments of the ruptured slip element radially outwardly into engagement with a surrounding tubular. The slip element is formed of a degradable material.

15 Claims, 5 Drawing Sheets

CONTROL INTERFACE FOR SEAL BACK-UP/SLIP

BACKGROUND OF THE INVENTION

1. Field of the Invention

The invention relates generally to the design of downhole slip assemblies and plug devices.

2. Description of the Related Art

Slips are used in packer devices and other downhole devices to create an anchoring engagement with a surrounding casing or other tubular member. Slip assemblies typically present an outer radial surface having teeth formed thereupon to bite into the interior surfaced of the surrounding tubular member. Slips are often formed of a rigid metal or other rigid material that is intended to break apart into arcuate slip segments when the slip element is set.

SUMMARY OF THE INVENTION

The present invention provides slip assembles and methods for setting a slip assembly. Downhole tools are described which incorporate a slip assembly in accordance with the present invention. In described embodiments, a plug device is described which includes a rupturable slip element, an expander swage element and a pusher sub. The expander swage element features a tapered outer surface.

In described embodiments, the slip element includes a cylindrical body having an unslotted, solid slip portion which is intended to be placed into contact with the surrounding tubular when set. A plurality of generally axial rupture slots are formed within slotted portions of the slip element. The rupture slots may take a number of forms or shapes, including straight and tortuous. The slots provide lines of predetermined weakness along which the solid portion of the slip element will fracture when the slip element is set. In embodiments, the plug device also includes an elastomeric packer element that will seal against the surrounding tubular when the plug is set. In instances where the rupture slots have a tortuous shape, the tortuous shape also helps prevent axial extrusion of the elastomeric packer element within the surrounding tubular past the slip element.

Preferably, the slip element is formed of a degradable, dissolving metal material, such as a controlled electrolytic metallic ("CEM") nanostructured material. This material is degradable or dissolvable over time in response to contact by brine. In some embodiments, the CEM material is covered by a polymeric or other coating which is not prone to dissolution or degradation in response to brine or similar fluids.

In described embodiments, the plug device includes a control interface, typically formed between the slip element and the pusher sub, which controls radial expansion of the separate slip element segments after the slip element has been ruptured. The control interface helps to ensure that the slip segments are guided radially outwardly into contact and engagement with the surrounding tubular. The control interface also helps ensure regular spacing between the slip segments, which in turn, helps prevent axial extrusion of the packer element past the slip element. In described embodiments, the pusher sub has a cylindrical body with an opening that receives an end portion of the slip element. In particular embodiments, the opening presents axially-extending control protrusions that are shaped and sized to reside within complementary recesses in the slip element.

To set the plug devices, the swage element and pusher sub are urged axially toward one another, typically with the assistance of a setting tool. The tapered outer surface of the swage element ruptures the slip element into separate slip segments and urges the ruptured slip segments into engagement with the surrounding tubular.

The inventors have determined that, when the slip assembly is located adjacent an elastomeric packer element, the regular spacing and substantially uniform loading of the slip segments is useful for preventing axial extrusion of the packer element after it is set. Irregular gaps between the slip segments are prevented, and rotation of the pusher sub with respect to the slip segments is prevented. The use of control protrusions and slotting in accordance with the present invention allows the slip assembly to load more evenly, thereby reducing the risk of subsequent failure.

BRIEF DESCRIPTION OF THE DRAWINGS

For a thorough understanding of the present invention, reference is made to the following detailed description of the preferred embodiments, taken in conjunction with the accompanying drawings, wherein like reference numerals designate like or similar elements throughout the several figures of the drawings and wherein.

DETAILED DESCRIPTION OF THE PREFERRED EMBODIMENTS

Figure 1:
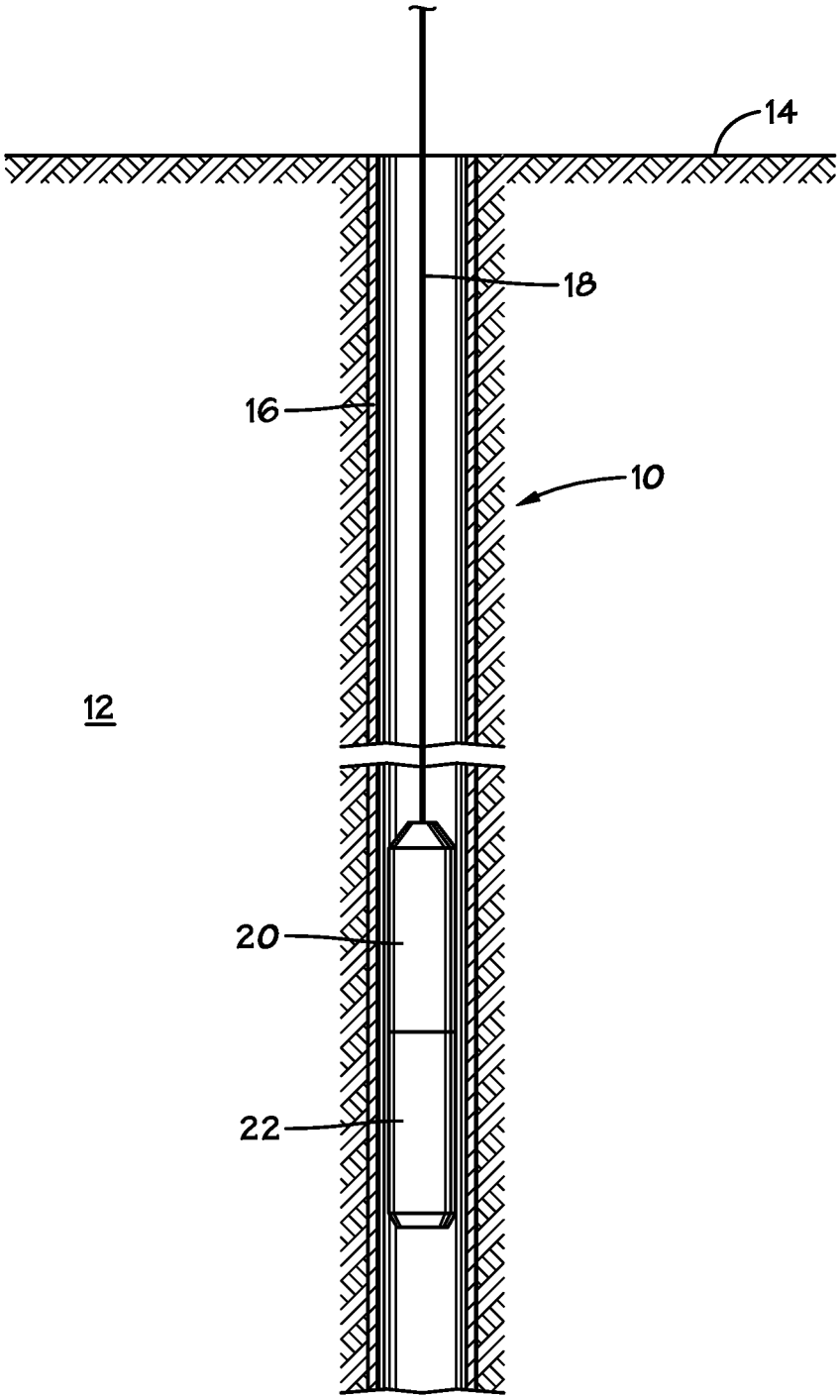
FIG. 1 is a side, cross-sectional view of a wellbore having a plug device and setting tool disposed therein.

FIG. 1 illustrates an exemplary wellbore 10 that has been drilled through the earth 12 from the surface 14. The wellbore 10 has been lined with metallic casing 16 of a type well known in the art. A running string 18 is disposed within the wellbore 10 from the surface 14. In the depicted embodiment, the running string 18 is a wireline. In alternative embodiments, however, the running string 18 may be coiled tubing or be made up of interconnected section of tubing sections, as is known. A setting tool 20 is secured to the lower end of the running string 18. A plug device 22, which is set by the setting tool 20 is affixed to the setting tool 20. The setting tool 20 functions to transmit axial setting forces to the plug device 22. In a currently preferred embodiment, the setting tool 20 is an explosive-based setting tool, such as the Baker E-4 Wireline Setting Tool which is available commercially from Baker Hughes Incorporated of Houston, Tex. In general operation, electrical current is transmitted from surface 14 along the wireline 18 to the setting tool 20.

The electrical current sets off an explosive charge in the setting tool 20 which generates the forces for setting the plug device 22.

Where otherwise not described, the plug device 22 generally is constructed and operates in the same manner as a Baker Hughes Model D packer. The plug device 22 may be set using a wireline setting tool of a type known in the art for setting devices such as the Model D packer within a wellbore. However, other setting mechanisms and techniques may also be used.

Figure 2:
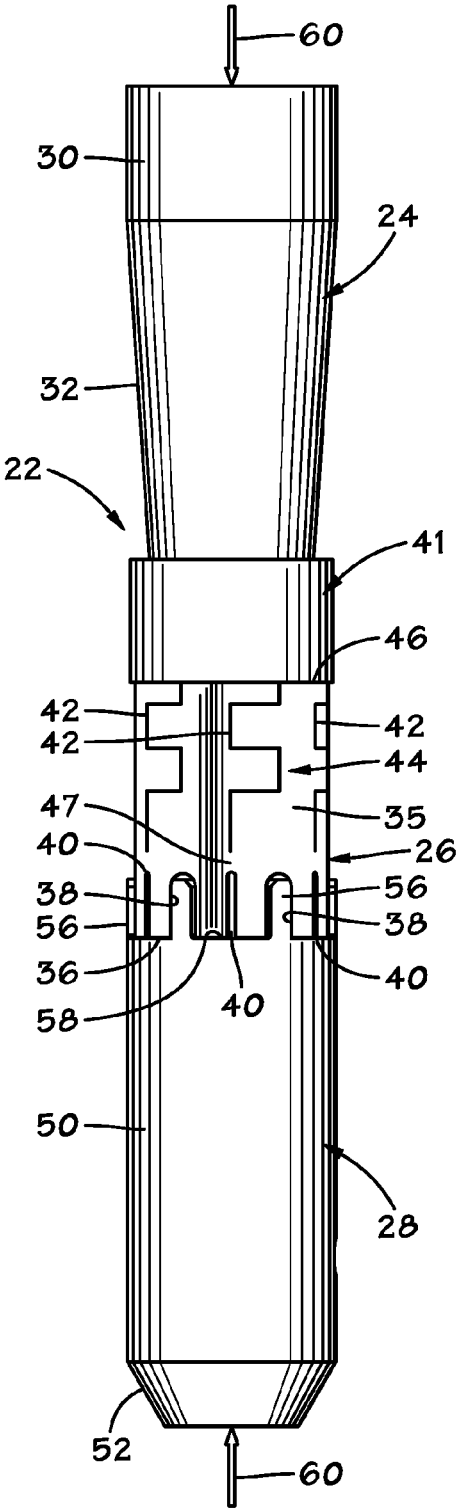
FIG. 2 is an external side view of an exemplary plug device constructed in accordance with the present invention.
Figure 3:
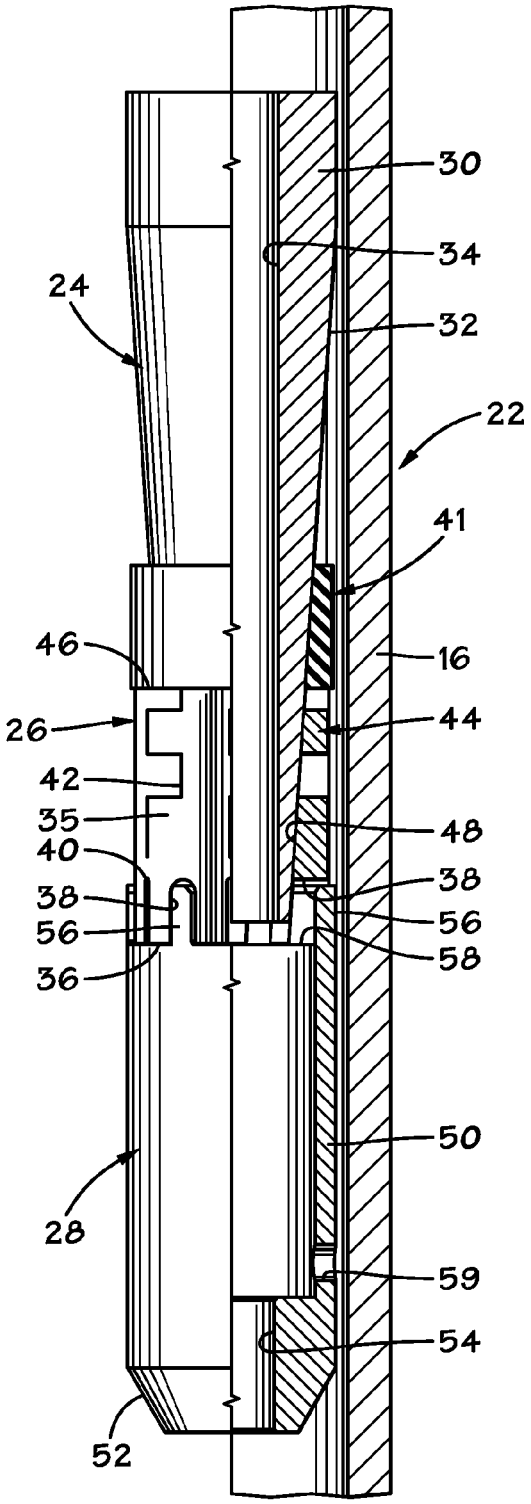
FIG. 3 is a side, partial cross-sectional view of the plug device of FIG. 2, now shown adjacent wellbore casing.
Figure 4:
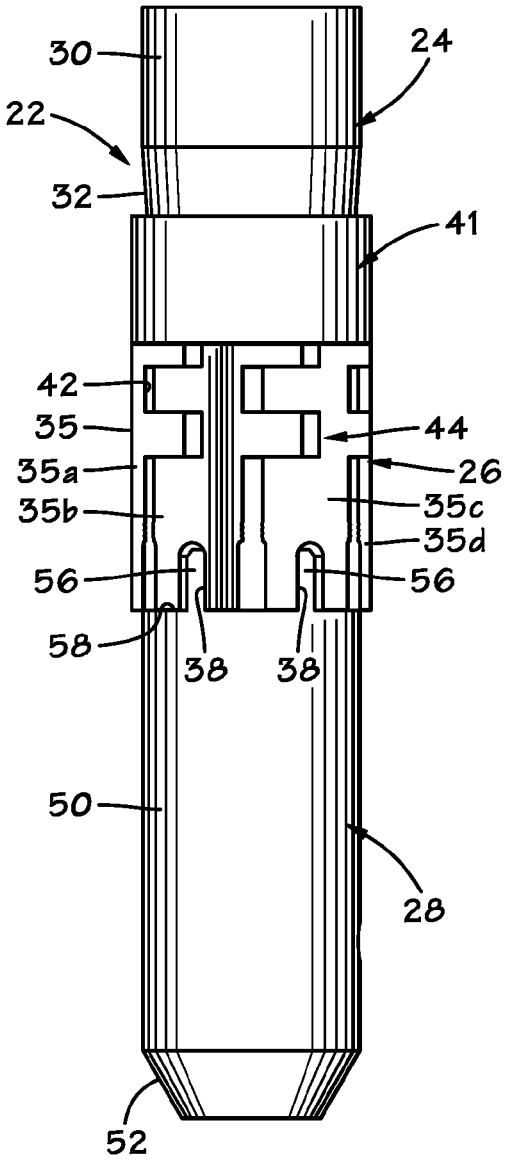
FIG. 4 is an external side view of the plug device shown in FIGS. 2-3 now having been set against the casing.

An exemplary plug device 22 is depicted in greater detail in FIGS. 2-4. The plug device 22 is generally made up of three major components: an expander swage element 24, a slip element 26 and a pusher sub 28. The expander swage element 24 has a cylindrical body 30 with tapered distal portion 32. An axial fluid flowbore 34 is formed within the expander swage element 24.

The slip element 26 has a cylindrical body 35 that is formed of a rigid, rupturable material. In preferred embodiments, the body 35 is formed of metal that is disintegrated or dissolves in response to contact by an appropriate fluid. In particular embodiments, the slip element 26 is made up of one or more decomposable metals such as that used in fabrication of IN-TALLIC® brand decomposable metallic components which are available commercially from Baker Hughes Incorporated of Houston, Tex. These metals are controlled electrolytic metallic ("CEM") nanostructured material. Disintegration of CEM materials works through electrochemical reactions that are controlled by nanoscale coatings within a composite grain structure. In certain embodiments, a slip element 26 formed of CEM material will disintegrate, dissolve or degrade over time during exposure to brine fluids. However, the actual degradation rate will depend upon the temperature and concentration of the brine. Also, acids will degrade the slip element 26 at a much higher rate. In particular embodiments, the slip element 26 has a protective coating that covers the degradable metal material of the slip element 26. When the slip element 26 is composed of degradable material, the plug device 22 is intended to function as a plug or packer device for a limited period of time and then degrade away. The ability to speed up the degradation process by adding acid to the wellbore 10 proximate the plug device 22 allows an operator to alter the time during which the plug device 22 is operative.

In particular embodiments, the degradable material making up the slip element 26 has a covering that is substantially non-degradable. In particular embodiments, the covering comprises a polymer that is not degradable in brine. In other embodiments, the slip element 26 is coated with a degradable polymer, such as TDI-Ester polyurethane. The degradable polymer will allow the slip element 26 to also seal against the casing 16 and subsequently degrade along with the remainder of the slip element 26.

In the embodiment shown in FIGS. 2-3, the slip element 26 does not have outer wickers for biting into the surrounding casing 16. It should be understood, however, that such wickers might be formed upon the outer radial surface of the slip element 26. The lower axial end 36 of the slip element 26 has a plurality of axially disposed recesses 38 formed therein. In addition, lower axial rupture slots 40 are preferably also formed within the lower axial end 36. An elastomeric sealing element or packer 41 is located adjacent the slip element 26.

Upper rupture slots 42 are formed in an upper portion 44 of the slip element 26. Preferably, the rupture slots 42 extend from the axial upper end 46 of the slip element 26. In the depicted embodiment, the upper rupture slots 42 are shaped in a tortuous fashion. The inventors have determined that the tortuous shape for the rupture slots 42 provides an advantage with respect to inhibiting potential extrusion of an elastomeric seal (such as sealing element 41) by providing a tortuous path through which the seal material must traverse in order to extrude axially along the wellbore casing 16. The body 35 of the slip element 26 also features a solid, unslotted portion 47. The slip element 26 also presents a central opening 48 which is tapered in a manner complementary to the tapered portion 32 of the expander swage element 24.

The pusher sub 28 includes a cylindrical body 50 having a rounded end nose 52. An interior diameter 54 is formed within the body 50. A plurality of control protrusions 56 project axially outwardly from the upper axial end 58 of the body 50. The control protrusions 56 are shaped and sized to reside within the recesses 38 of the slip element 26. The control protrusions 56 reside within the recesses 38 and each protrusion 56 is moveable radially inwardly and outwardly within its recess 38. A lateral fluid port 59 is disposed through the pusher sub 28 which allows for fluid bypass during setting of the plug device 22.

Figure 5:
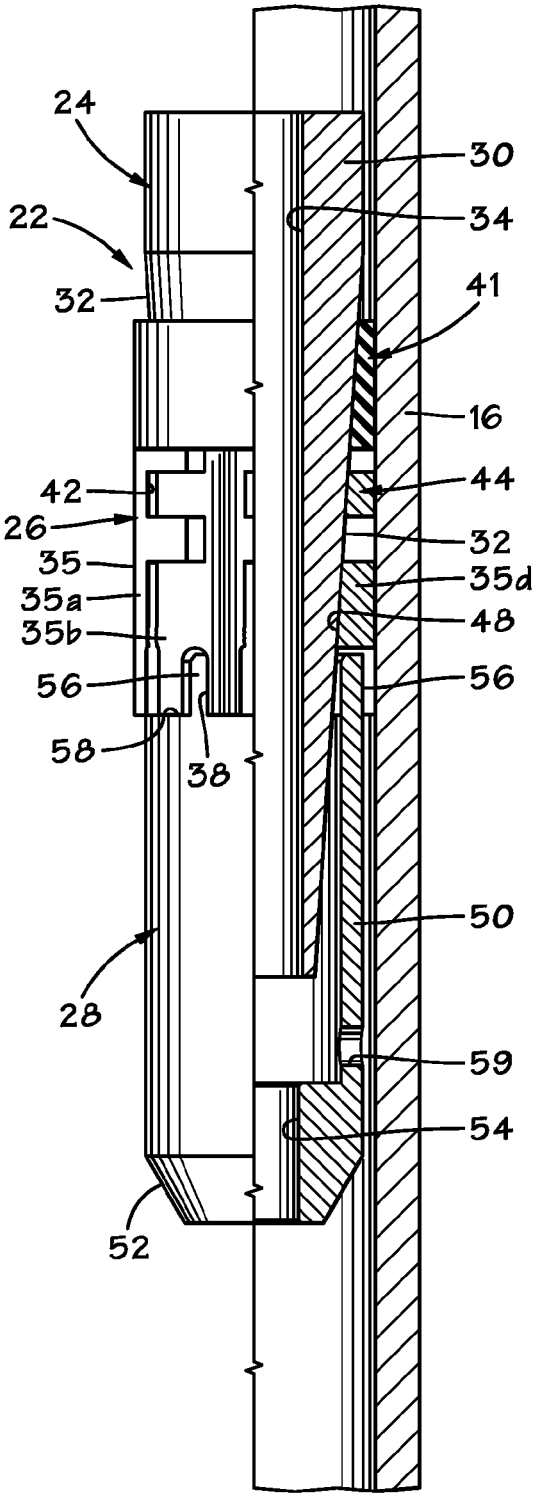
FIG. 5 is a side, partial cross-sectional view of the set plug device of FIG. 4.

In order to set the plug device 22, the setting tool 20 applies axial setting forces to the swage element 24 and the pusher sub 28. The axial setting forces are illustrated by arrows 60 in FIG. 2. When the setting forces are applied, the swage element 24 causes the slip element 26 to be ruptured. FIGS. 4-5 illustrate the plug device 22 in a set position wherein the slip element 26 has been ruptured so that the slip element 26 and sealing element 41 are set against the casing 16. The solid portion 47 of the body 35 of the slip element 26 is ruptured so that the ruptured segments 35*a*, 35*b*, 35*c*, 35*d* are separated along lines that are in alignment with the rupture slots 40, 42. As the slip segments 35*a*, 35*b*, 35*c*, 35*d* are urged radially outwardly by the expander swage 24, the aligned control protrusions 56 and recesses 38 act as guides to ensure that the slip segments 35*a*-35*d* are loaded against the casing 16 evenly and in a uniformly spaced manner. As a result, the control protrusions 56 and recesses 38 control the gaps between the slip segments 35*a*-35*d*. It is noted that the control protrusions 56 and recesses 38 are preferably located about the circumference of the plug device 22 in a uniform spaced configuration.

Figure 6:
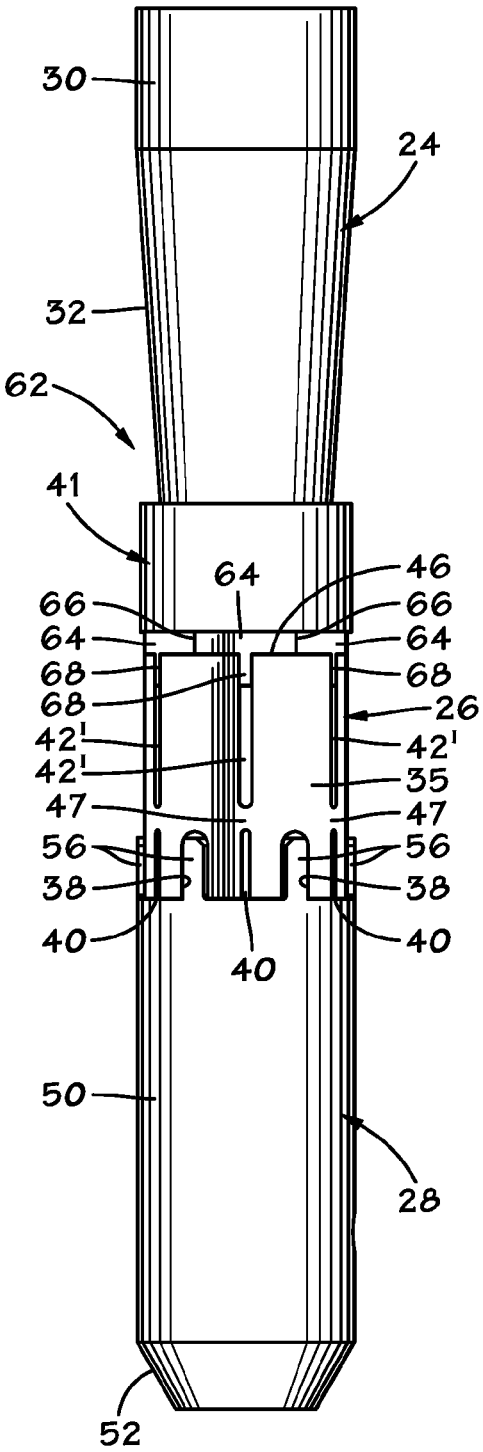
FIG. 6 is an external side view of an alternative plug device in accordance with the present invention.
Figure 7:
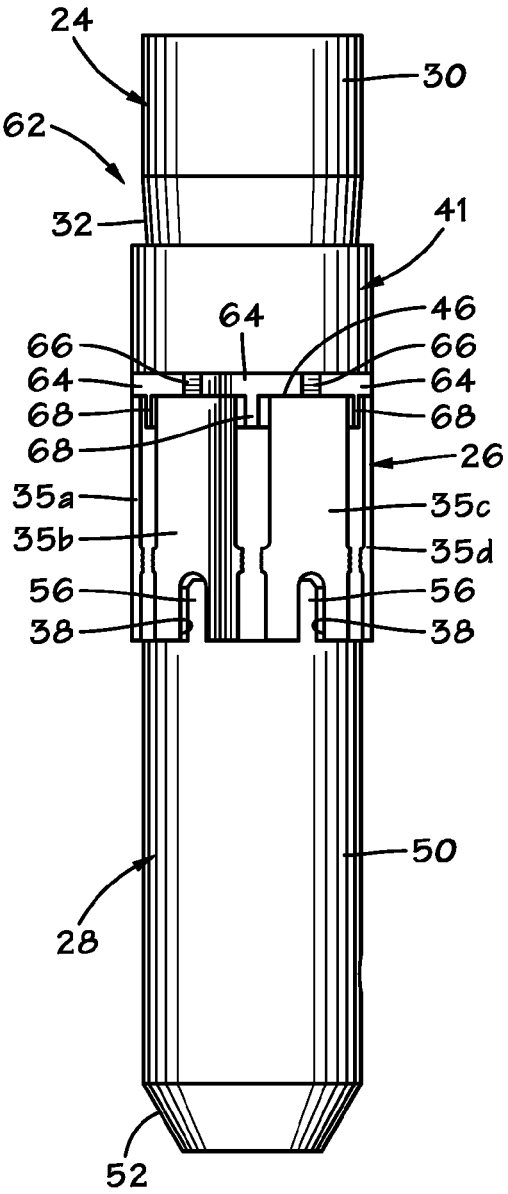
FIG. 7 is an external side view of the plug device shown in FIG. 6, now having been set.

FIGS. 6-7 illustrate an alternative embodiment for a plug device 62 that is constructed in accordance with the present invention. The plug device 62 is similar in many respects to the plug device 22 described previously. Where not otherwise described, the plug device 62 is constructed and operates in the same manner as the plug device 22. In this embodiment, the upper rupture slots 42' in the slip element 26 have a straight linear configuration rather than a tortuous shape. A set of arcuate support segments 64 is disposed radially within the upper end 46 of the slip element 26. The support segments 64 also preferably underlie a portion of the seal element 41. It is noted that the separations 66 between adjacent support segments 64 are radially offset from the rupture slots 42' of the slip element body 35. Preferably also, raised ridges 68 on the support segments 64 reside within the upper rupture slots 42'. The ridges 68 function to keep the support segments 64 in alignment with the slip element 26. The ridges 68 also ensure that the support segments 64 will block the sealing element 41 from extruding into the rupture slots 42' of the slip element 26.

FIG. 6 depicts the plug device 62 in a run-in condition, prior to it having been set. FIG. 7 depicts the plug device 62 after setting. When the expander swage element 24 is moved axially to rupture the slip element 26, the support segments 64 help to ensure that the sealing element 41 does not extrude axially through the now enlarged rupture slots 42' and thereby serve basically the same purpose as the tortuous shape of the slots 42 described previously.

Figure 8:
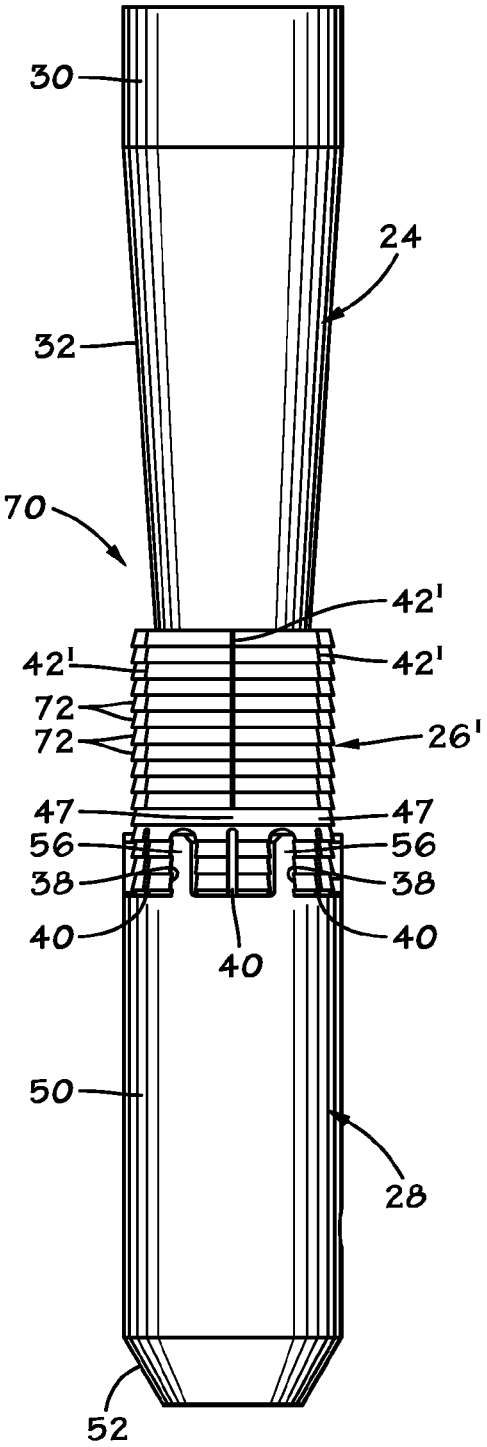
FIG. 8 is an external side view of a further alternative plug device in accordance with the present invention.
Figure 9:
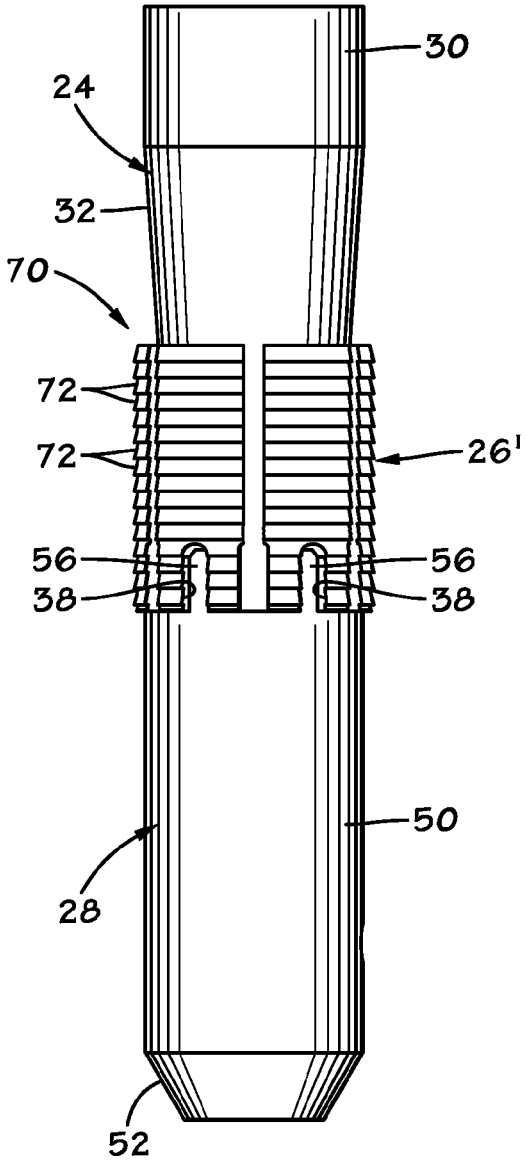
FIG. 9 is an external side view of the plug device shown in FIG. 8, now having been set.

FIGS. 8-9 illustrate a further alternative plug device 70 wherein certain components, including the slip element 26', are constructed differently in a number of respects. There is no elastomeric seal element, such as seal element 41. The slip element 26' presents a radially outer surface with wickers 72 that are intended to bite into the surrounding tubular (i.e., casing 16) when the plug device 70 is set. The slip element 26' could be embedded with a hard material, such as carbide, to form the wickers 72. It is noted that wickers such as 72 could be formed upon any of the slip elements described herein.

The inventors have determined that, when the slip element (26, 26') is located adjacent an elastomeric packer element 41, the regular spacing and substantially uniform loading of the slip segments is useful for preventing axial extrusion of the packer element 41 after it is set. Irregular gaps between the slip segments (35*a*-35*d*) are prevented. The use of control protrusions 56 and slotting 38 in accordance with the present invention allows the slip assembly to load more evenly, thereby reducing the risk of subsequent failure.

After a slip element 26 or 26' formed of degradable material is set so that the slip element body 35 is separated into slip segments 35*a*-35*d*, the segments 35*a*-35*d* will degrade over time in response to brine within the wellbore 10. In instances where the slip element 26, 26' has a non-degradable coating, breaking up of the slip element 26 or 26' into slip segments 35*a*-35*d* would expose the degradable material of the slip element 26, 26' to the brine. The coating is then useful for protecting the slip element 26, 26' from dissolving or degrading prematurely.

It is noted that plug devices of the present invention may have various alternative constructions. For example, control protrusions (56) might be formed on the slip element (26) while recesses (38) are formed on the pusher sub (28). Also, while the control protrusions 56 that are depicted in the drawings have a generally elongated rectangular shape, they may have a curved arcuate profile which interfits with a complementary arcuate profile on the pusher sub 28, thereby providing a curved wave interface. Other interlocking profiles which function to prevent relative rotation of the pusher sub 28 and respect to the slip element 26 might be used as well. Those of skill in the art will recognize that numerous modifications and changes may be made to the exemplary designs and embodiments described herein and that the invention is limited only by the claims that follow and any equivalents thereof.

What is claimed is:

1. A plug device for forming a locking engagement with a surrounding tubular member in a wellbore, the plug device comprising:

a cylindrical slip element that is rupturable into slip segments to be set into the surrounding tubular;

a pusher sub to apply axial force to the slip element to aid in rupturing the slip element;

a slotted portion of the slip element having at least one rupture slot disposed through the slip element prior to the slip element being ruptured and extending from an axial end of the slip element;

a solid, unslotted portion of the slip element which is broken as the slip element is ruptured; and a support segment having a portion disposed within the rupture slot in the slip element to inhibit axial extrusion of an elastomeric sealing element.

2. The plug device of claim 1 further comprising a swage element to expand the slip element radially outwardly and rupture it into slip segments.

3. The plug device of claim 1 further comprising:

a control protrusion formed upon either the slip element or the pusher sub;

a recess formed upon the other of the slip element or the pusher sub and being shaped and sized to receive the control protrusion therein, the control protrusion residing within the recess; and the control protrusion and recess guiding outward radial movement of at least one of the slip segments.

4. The plug device of claim 1 wherein the slip element is formed of a material which is degradable in response to an appropriate fluid.

5. The plug device of claim 1 wherein the slip element has a coating.

6. The plug device of claim 1 wherein the slip element presents a radially outer surface having wickers to bite into the surrounding tubular.

7. The plug device of claim 6 wherein the wickers are formed by embedding a hardened material in the slip element.

8. A plug device for forming a locking engagement with a surrounding tubular member in a wellbore, the plug device comprising:

a cylindrical slip element that is rupturable into slip segments to be set into the surrounding tubular;

a pusher sub to apply axial force to the slip element to aid in rupturing the slip element;

a swage element to expand the slip element radially outwardly and rupture it into slip segments;

a slotted portion of the slip element having at least one rupture slot disposed through the slip element, the rupture slot having a tortuous shape; and a support segment having a portion disposed in the at least one rupture slot to inhibit axial extrusion of an elastomeric sealing element between the slip segments.

9. The plug device of claim 8 wherein the slip element is formed of a controlled electrolytic metallic nanostructured material which is degradable in response to an appropriate fluid.

10. The plug device of claim 8 wherein the slip element has a coating.

11. The plug device of claim 8 wherein the slip element presents a radially outer surface having wickers to bite into the surrounding tubular.

12. The plug device of claim 11 wherein the wickers are formed by embedding a hardened material in the slip element.

13. A method for setting a plug device within a surrounding tubular in a subterranean location, the method comprising the steps of:

disposing the plug device into the surrounding tubular, the plug device having a cylindrical slip element that is rupturable into slip segments to be set into the surrounding tubular, a pusher sub to apply axial force to the slip element to aid in rupturing the slip element, a control protrusion formed upon either the slip element or the pusher sub, a recess formed upon the other of the slip element or the pusher sub and being shaped and sized to receive the control protrusion therein, the control protrusion residing within the recess and being moveable radially inwardly and outwardly therewithin;

applying axial force to the pusher sub to rupture the slip element into slip segments;

the control protrusion and recess guiding outward radial movement of at least one of the slip segments as it is set into the surrounding tubular;

the plug device further comprising a slotted portion of the slip element having at least one rupture slot disposed through the slip element prior to the slip element being ruptured and extending from an axial end of the slip element; and wherein the slot has a tortuous shape that limits axial extrusion of an elastomeric seal element past the slip segments.

14. The method of claim 13 wherein:

the plug device further comprises a slotted portion of the slip element having at least one rupture slot disposed through the slip element from an axial end of the slip element; and a guide segment disposed radially within the slip element; and wherein the support segment prevents axial extrusion of an elastomeric sealing element between the slip segments after the plug element has been set.

15. The method of claim 13 wherein:

the slip element is formed of a material that is degradable in response to a suitable fluid.

* * * * *